US007211151B2

(12) United States Patent
Takekoshi et al.

(10) Patent No.: US 7,211,151 B2
(45) Date of Patent: May 1, 2007

(54) COATING LIQUID APPLICATION APPARATUS, IMAGE PRINTING APPARATUS AND COATING LIQUID APPLICATION METHOD

(75) Inventors: Nobuhiko Takekoshi, Kanagawa (JP); Tetsuo Kikuchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 11/128,213

(22) Filed: May 13, 2005

(65) Prior Publication Data

US 2005/0214473 A1 Sep. 29, 2005

Related U.S. Application Data

(62) Division of application No. 10/196,355, filed on Jul. 17, 2002, now Pat. No. 6,960,259.

(30) Foreign Application Priority Data

Jul. 19, 2001 (JP) ..... 2001-220488

(51) Int. Cl.
*B05C 1/08* (2006.01)

(52) U.S. Cl. ..... 118/603; 118/610; 118/236; 118/249; 118/259; 118/262; 118/46; 347/101; 347/103; 347/104

(58) Field of Classification Search ..... 118/603, 118/610, 236, 249, 258, 259, 262, 46; 347/101, 347/103, 104; 427/428.15, 428.17
See application file for complete search history.

(56) References Cited

U.S. PATENT DOCUMENTS

| | | | | |
|---|---|---|---|---|
| 5,079,044 | A | 1/1992 | Schumacher et al. | 427/428 |
| 5,368,891 | A | 11/1994 | Sagara et al. | 427/258 |
| 5,650,010 | A | 7/1997 | Rantanen et al. | 118/224 |
| 6,120,199 | A | 9/2000 | Takekoshi | 400/611 |
| 6,183,079 | B1 | 2/2001 | Meade et al. | 347/101 |
| 2003/0024474 | A1 | 2/2003 | Suzuki et al. | |

FOREIGN PATENT DOCUMENTS

| | | |
|---|---|---|
| JP | 53-64249 | 6/1978 |
| JP | 59-127764 | 7/1984 |
| JP | 64-85766 | 3/1989 |

*Primary Examiner*—Laura Edwards
(74) *Attorney, Agent, or Firm*—Fitzpatrick, Cella, Harper & Scinto

(57) ABSTRACT

A coating liquid application apparatus is provided which can apply a coating liquid, such as a coating agent for improving a weatherability of a printed surface, to the printed surface of a print medium automatically and at high speed. For this purpose, this invention uses application mechanisms to apply the coating liquid to the print medium that was ink-printed with an image. Each application mechanism has a pair of rollers supplied with the coating liquid. Multiple stages of such application mechanisms are provided. The print medium is passed between the paired rollers successively from one application mechanism to another to apply the coating liquid to the print medium in a plurality of stages.

11 Claims, 7 Drawing Sheets

COATING LIQUID APPLICATION APPARATUS, IMAGE PRINTING APPARATUS AND COATING LIQUID APPLICATION METHOD

This application is a division of application Ser. No. 10/196,355 filed Jul. 17, 2002, now U.S. Pat. No. 6,960,259.

This application is based on Patent Application No. 2001-220488 filed Jul. 19, 2001 in Japan, the content of which is incorporated hereinto by reference.

BACKGROUND OF THE INVENTION

1. Field of the Invention

The present invention relates to a coating liquid application apparatus that applies to a printed surface of a print medium a coating liquid or the like for improving weatherability and glossiness of the printed surface, an image printing apparatus having the liquid application apparatus, and a coating liquid application method.

2. Description of the Related Art

Image printing apparatus with functions of printers, copying machines and facsimiles or image printing apparatus used as output devices for composite machines and workstations, including computers and word processors, are constructed to print images (including characters and symbols) on print mediums such as paper and plastic thin sheet (e.g., OHP) according to image information. The image printing apparatus may be classified into an ink jet printing system, a wire dot printing system, a thermal printing system, a thermal transfer printing system, and a laser beam printing system according to the printing method of the printing means used.

Of these, the ink jet system has been spotlighted in recent years as a printing system that can easily produce an image quality almost identical with that of a silver salt picture. An ink jet system using a dye ink in particular has an excellent color reproducibility and can produce a high image quality equal to or even higher than that of a silver salt picture system. The ink jet printing system, however, has a problem that an output printed medium has poor weatherability and is known to fade when subjected to gases such as ozone, light and water. Hence, it has conventionally been proposed to laminate the printed medium, on which an image was formed, with a film or the like to prevent a possible degradation of the printed image.

Other conventional methods that have been proposed or practiced to deal with this problem include using special glossy paper, increasing the amount of ink to be ejected, or laminating the printed surface as described above.

It is, however, considered difficult to construct a post processing device, that performs the laminate processing as described above, in such a way that the user can easily handle it. To realize the post processing device which can automatically laminate the print medium, there are the following problems that need to be solved.

First, there is a problem of running cost. The laminate processing generally involves bonding to the print medium under pressure or by heat a transparent film, larger in size than the print medium, which is coated with an adhesive. Hence, when the size changes, excess portions must be removed, increasing the running cost.

A second problem is an increased size of the post processing device and its installation space. In performing the laminate processing, the post processing device needs a space therein in which to form a laminate film in advance in conformity with the shape of a cartridge accommodating the laminate film for easy replacement of the film or in which to cut the laminated print medium, and also a space in which to accommodate an excess laminate material. This in turn increases the size of the post processing device and requires a large space for its installation.

A third problem is device cost. To automatically laminate a print medium in a required size, which was inserted by the user or automatically printed with an image by the printing apparatus, ancillary portions such as a film storage portion and a print medium cutting mechanism are required in addition to the laminate processing mechanism, increasing the overall cost of the apparatus.

To eliminate these problems, it is conceivable that the ancillary portions such as the cutting mechanism may be omitted and that the excess part that was formed after the laminate processing may be cut off by the user. However, this will drastically increase the work that needs to be done by the user, significantly deteriorating the performance of the post processing device.

While a process is proposed which transfers only the laminate layer as by heat (so-called thermal transfer process), the use of the laminate layer that can easily be transferred requires the film strength to be reduced. This gives rise to new problems, such as the overall print medium becoming very weak in terms of mechanical strength and a base material for holding the laminate layer becoming waste after the process.

Further, the thermal ink jet printing system using electrothermal transducers heats ink to project an ink droplet, so that there is a limitation on the kind of ink that can be used. For example, the use of an ink with a sufficiently high dye density raises problems that need to be solved to prevent a scorching of the ink. Therefore, it is difficult to improve the density of an image using such an ink.

Further, when a print medium that has undergone preprocessing for enhancing the image density, such as glossy paper, is used as described earlier, the print medium itself becomes very expensive, increasing the running cost. Further, when the amount of ink to be ejected is increased, problems such as the spreading of printed ink and the waving of the print medium become more likely to occur, depending on the amount of ink that the print medium can absorb.

SUMMARY OF THE INVENTION

The present invention has been accomplished with a view to overcoming the problems with the conventional techniques and provides a coating liquid application apparatus capable of automatically applying a coating liquid, which improves a weatherability of a printed surface, to the printed surface of a print medium at high speed and in a proper manner. The invention also provides an image printing apparatus having the coating liquid application apparatus.

According to a first aspect, the present invention provides a coating liquid application apparatus for applying a coating liquid to a print medium that was ink-printed with an image, comprising: a plurality of stages of application mechanisms each having a pair of rollers supplied with the coating liquid; wherein the print medium is passed between the paired rollers successively from one application mechanism to another to apply the coating liquid to the print medium in a plurality of stages.

With this invention, not only can the application of the coating liquid, such as a post processing liquid, designed to improve a weatherability and an image quality of the print medium, be performed automatically but a necessary and sufficient amount of the coating liquid can also be applied at high speed and in a proper condition.

According to a second aspect, the present invention provides a coating liquid application apparatus for applying a coating liquid to a print medium that was ink-printed with an image, comprising: first stage to nth stage application mechanisms each having a pair of rollers supplied with the coating liquid ($n \geqq 2$); wherein positions of the pairs of rollers of the application mechanisms are shifted upwardly with respect to a gravity direction, with the first stage pair of rollers arranged at a lowest position and the nth stage pair of rollers arranged at a highest position; wherein the print medium is passed between the paired rollers successively from the first stage application mechanism to the nth stage application mechanism to apply the coating liquid to the print medium in a plurality of stages.

With this invention, even when the coating liquid is applied in excess amounts or a print medium feeding failure occurs, it is possible to prevent the coating liquid from flowing down the print medium and dripping and to reduce the installation area for the apparatus.

According to a third aspect, the present invention provides a coating liquid application apparatus, in which an amount of the coating liquid to be applied in at least the first stage application mechanism is set smaller than that to be applied in the second stage application mechanism.

With this invention, even when the coating liquid is applied excessively in the second or subsequent stages and the excess liquid drips down, the dripping, excess coating liquid can be received by the first stage and then applied to the print medium. It is also possible to prevent an excess application of the coating liquid only at the first stage.

According to a fourth aspect, the present invention provides an image printing apparatus comprising: a printing means for performing an ink jet printing on a print medium; and an application means for applying a coating liquid to the printed print medium; wherein the application means is the coating liquid application apparatus.

According to a fifth aspect, the present invention provides an image printing apparatus comprising: a printing means for performing an ink jet printing on a print medium; an application means for applying a coating liquid to the printed print medium; and a tank for supplying the coating liquid to the application means; wherein the application means is arranged above the printing means and the tank is arranged below the printing means so that the application means overlaps the tank in a vertical direction.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described by referring to the accompanying drawings.

(Technology Related to Coating Liquid Application Apparatus of the Present Invention)

Figure 1:
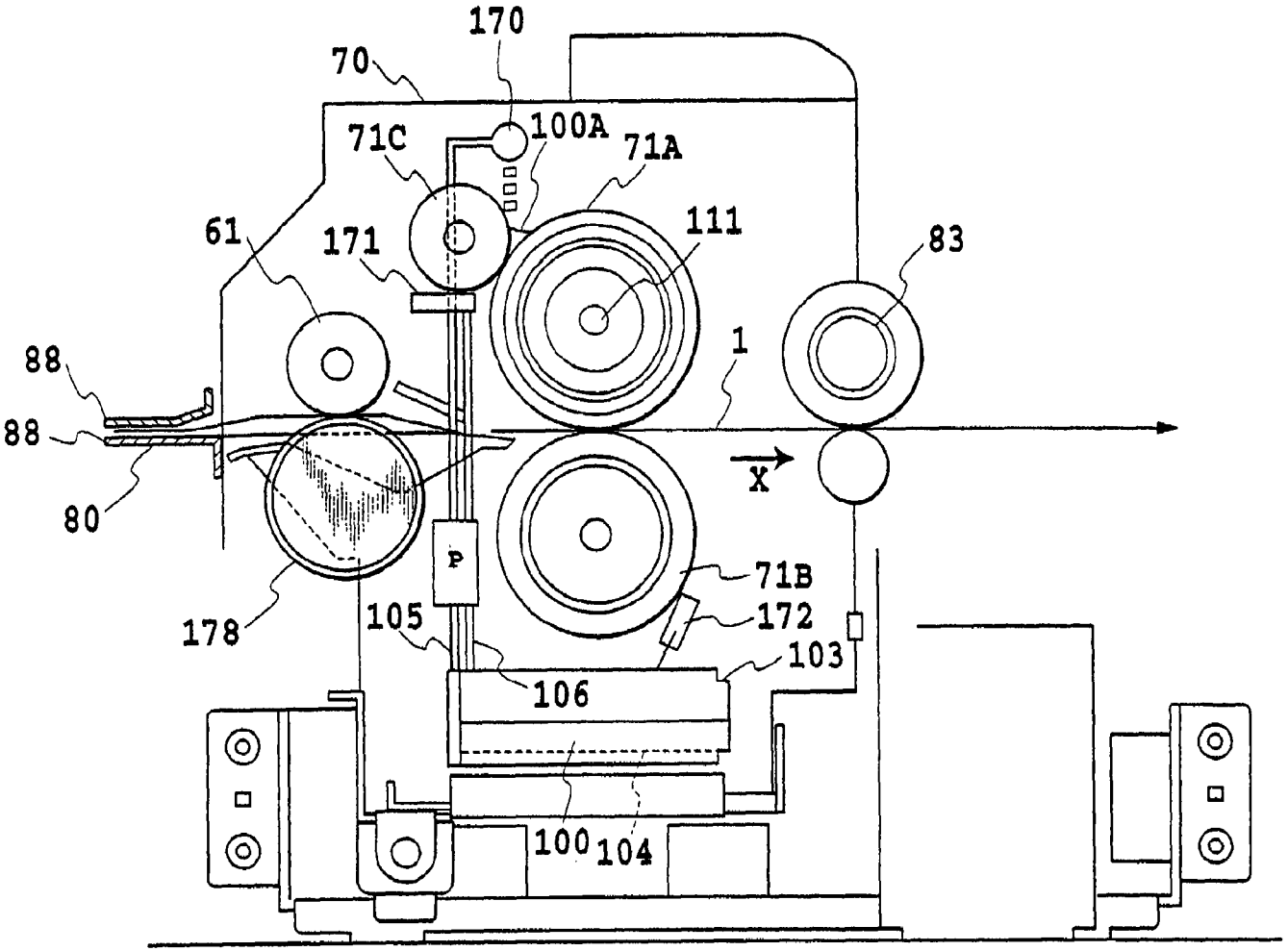
FIG. 1 is a vertical side cross-sectional view showing technology related to the coating liquid application apparatus of the present invention.
Figure 3:
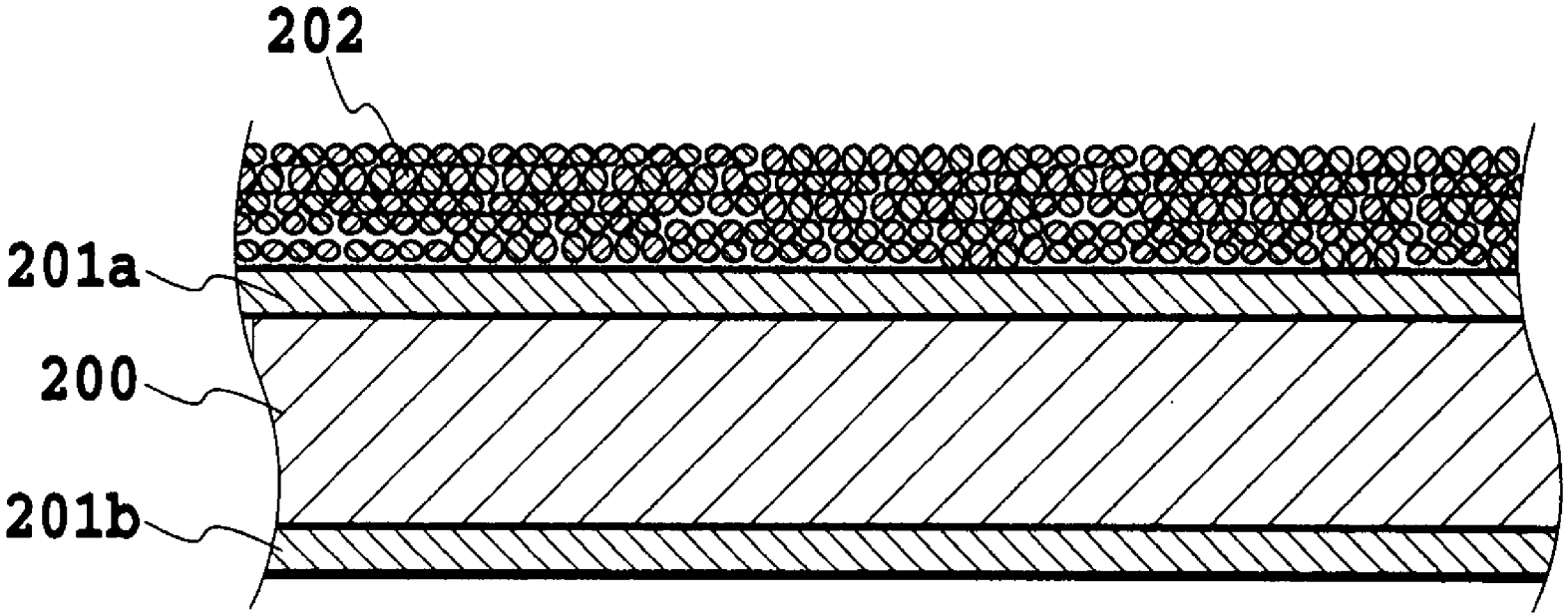
FIG. 3 is a vertical side cross-sectional view showing a layer structure of a print medium applied to the apparatus of FIG. 1.

With reference to FIG. 1 and FIG. 3, a basic technology related to the coating liquid application apparatus of this invention will first be explained.

A coating liquid application apparatus taken as an example of the related technology protects a printed surface of a print medium (to provide it with a weatherability) by, after an image has been formed on an ordinary print medium for ink jet printing with an ink jet print head, applying a printed surface protection liquid (coating liquid) to the image-formed surface (printed surface) of the print medium and allowing the liquid to soak in the printed surface.

Here, a layer structure of the print medium used in this embodiment will be explained by referring to FIG. 3.

The print medium shown here comprises a base material 200 made from paper which has both surfaces thereof coated simultaneously with resin layers 201*a*, 201*b* of, for example, polyethylene and then has one of its coated surfaces further coated with an ink reception layer 202 as shown in the figure. This print medium is dedicated for use with ink jet printing apparatus.

Rather than having the both surfaces of the base material coated with the resin layers 201*a*, 201*b*, the print medium may have only one surface of the base material 200 coated with the resin layer.

It is noted, however, that coating the resin layer over a surface opposite the ink reception layer (i.e., back surface), too, as shown in FIG. 3 can produce the following effects. One such effect is to prevent a coating liquid from penetrating into the base material 200 from the back surface during a coating liquid application process described later and then forming stains. Another effect is that, when coated print mediums are stacked one upon the other with their printed surfaces facing in the same direction, the coating liquid applied to the surface (printed surface) of one print medium can be prevented from being absorbed by the back surface of a print medium lying immediately above. Such effects can be produced in other structures. For example, the similar effects can be expected when the ink reception layer 202 is formed over a film of polyethylene terephthalate or glass.

As described above, the provision on the print medium of a layer of the material, such as resin, through which the coating liquid hardly penetrates into the base material can produce an effect of preventing ink from penetrating excessively into the base material and forming stains.

This embodiment is also effective for print mediums other than those described above, for example, print mediums without a resin layer. When print mediums without a resin layer are used, the aforementioned problem can be dealt with by reducing the amount of the coating liquid to prevent the applied coating liquid from getting into the base material, or by using a material for the base material which, if the coating liquid should penetrate into the base material, makes the penetrated liquid less noticeable or by using a material through which the coating liquid can hardly penetrate.

Preferred coating liquids to be applied to the print mediums include dimethyl silicone oils, silicone oils modified by such functional groups as phenyl and alkyl groups, and ester-based oil and varnish. Inert and transparent liquids are more preferable. That is, the use of an inert coating liquid can suppress problems that would otherwise be caused by various reactions during the handling of the liquid, and the use of a transparent coating liquid can suppress changes in hue of the printed image after being applied with the coating liquid.

FIG. 1 is an explanatory vertical side cross-sectional view showing the coating liquid application apparatus described above that applies a coating liquid to the printed surface of the print medium.

In the figure, when a print medium is inserted into an inlet guide 88, with its surface formed with an image (a surface formed with the ink reception layer 202) facing up, a medium sensor 80 detects the print medium inserted, initiating a sequence of the coating operation.

A coating liquid 100 is stored in a coating liquid tank 103 in advance, as shown. The coating liquid 100 is pumped up by a pump P through a pipe 105 to a drip member 170 arranged in a top part of the apparatus. The drip member 170 is a pipe extending in a direction perpendicular to a print medium feed direction X (direction perpendicular to the plane of a sheet of the drawing). The pipe forming the drip member 170 has small holes formed in the circumferential surface thereof at almost equal intervals in a longitudinal direction. Thus, the coating liquid 100 pumped up to the drip member 170 drops almost uniformly over the entire length of the drip member 170 through its small holes and is received by an application roller 71A and an application restriction roller 71C, both located below the drip member 170. The coating liquid 100 thus received by the two rollers 71A and 71C passes through a gap between the rollers 71A and 71C and adheres to the application roller 71A, from which it is transferred to a feed roller 71B arranged opposite the application roller 71A. At this time, the application restriction roller 71C is rotating in the same direction as the application roller 71A so that a resistance is imparted to the coating liquid 100 as it passes through the gap between the rollers 71A and 71C. Hence, a puddle 100A of the dripped coating liquid is formed between the rollers 71A and 71C, as shown in FIG. 1. That is, while forming a puddle between the rollers 71A, 71C, the coating liquid is fed down the rollers' gap. If there are variations in the coating liquid dripping condition, the puddle 100A can absorb the variations completely, ensuring that an appropriate amount of the coating liquid is almost uniformly applied to the application roller 71A.

The print medium inserted from the inlet guide 88 is carried by a pair of feed rollers 61, 178 to an engagement portion (nip portion) between the application roller 71A and the feed roller 71B. When it reaches the nip portion between the application roller 71A and the feed roller 71B that are rotating in opposite directions at the same speed, the print medium is clamped between and fed by the two rollers in the feed direction X and is also applied uniformly with the coating liquid 100 adhering to the application roller 71A. Since the application roller 71A has a thin film of the coating liquid adhering uniformly thereto as described earlier, the coating liquid as applied to the print medium is also uniform.

The coating liquid application apparatus of this embodiment is contemplated to use a print medium intended to be printed on only one side thereof (front surface) as shown in FIG. 3, with the back surface not applied with a large amount of coating liquid. The print medium, such as shown in FIG. 3, has a resin layer 201*b* on the back surface and thus the coating liquid 100 is not absorbed in the back surface. If the coating liquid is applied to the back surface of the print medium, the back surface feels sticky, which in turn makes the user uncomfortable and degrades the writability of the medium, the adhesion with paste and the ease of handling. To eliminate these problems, a rubber blade 172 is arranged below the feed roller 71B, as shown in FIG. 1, to scrape the coating liquid 100 off the feed roller 71B and thereby minimize the application of the coating liquid to the back surface of the print medium.

The coating liquid scraped off by the rubber blade 172 is allowed to drop into the coating liquid tank 103 for recovery. Further, the scraped coating liquid 100 is passed through a filter 104 to prevent impurities such as paper dust from being supplied onto the application roller 71A.

Not only is this filter 104 used for removing impurities during the coating liquid application operation, it can also be applied to other operations (such as a cleaning mode) in which the coating liquid 100 is circulated through the filter to remove impurities deposited on the application roller 71A and the feed roller 71B.

Further, provided below and out of contact with the application restriction roller 71C is a coating liquid receiver 171, which is designed to receive an excess amount of the coating liquid 100 that overflowed from the application restriction roller 71C when the coating liquid 100 drips too heavily between the rollers (or on either of them). The coating liquid 100 received there is immediately recovered to the coating liquid tank 103 through a discharge pipe 106. In this construction the coating liquid 100 can be circulated at all times in the apparatus to prevent a wasteful discarding of the coating liquid.

(Technology Related to Image Printing Apparatus of the Present Invention)

Next, a basic technology related to the image printing apparatus of this invention will be explained.

Figure 2:
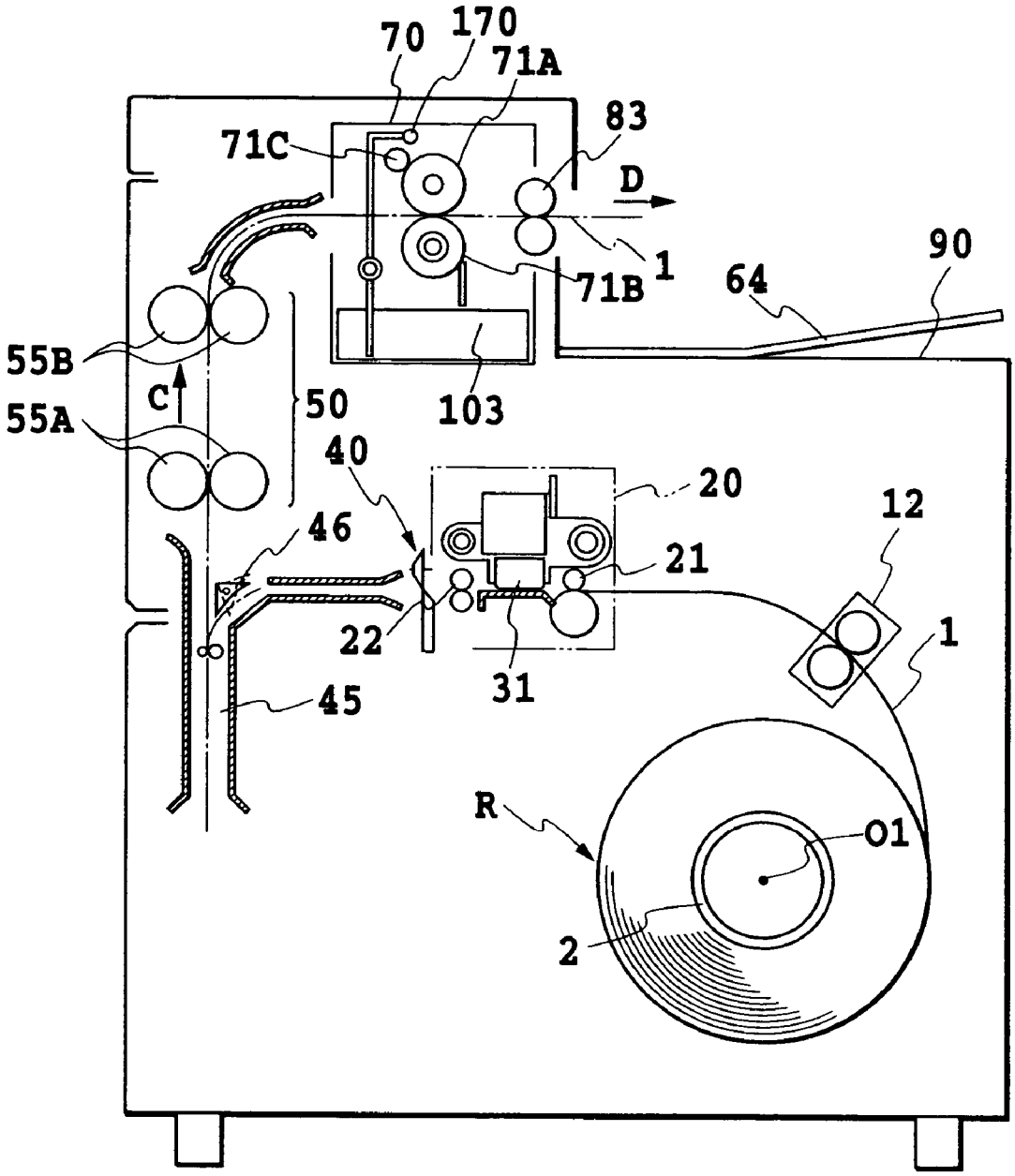
FIG. 2 is a vertical side cross-sectional view showing technology related to the image printing apparatus of the present invention.

An image printing apparatus taken as an example of the related technology has incorporated therein the coating liquid application apparatus described above with reference to FIG. 1 and has a construction as shown in FIG. 2.

As shown in FIG. 2, in an image printing apparatus 90 a roll of print medium wound on a paper core 2 is accommodated in a cartridge (not shown). The paper core 2 is supported rotatably about an axis O1. The print medium 1 payed out from the roll R is passed between a pair of rollers 12 and fed to a print unit 20 which has an ink jet print head 31.

Then, between a pair of feed rollers 21 and a pair of feed auxiliary rollers 22 the print medium is printed with an image by ink droplets ejected from ink ejection nozzles of the ink jet print head 31.

The ink jet print head 31 is constructed to use, for example, thermal energy to expel ink droplets from the ink ejection nozzles. The print head 31 is provided with electrothermal transducers, one for each nozzle. Each electrothermal transducer is applied with a drive pulse according to print data to generate heat, which causes film boiling in the ink whereby a growth of a bubble expels an ink droplet from the associated ink ejection nozzle. Another example of the widely used ink jet print head 31 uses electromechanical transducers, such as piezoelectric elements, that change their volume upon application of electric energy and expel ink droplets from the ink ejection nozzles by their volume change.

Designated 40 is a cutter unit as a cutting means provided downstream of the print unit 20. The cutter unit 40 cuts to a desired length the print medium 1 that was fed from the roll and printed with an image by the print unit 20. Denoted 50 is a feed means which has a buffer effect of ensuring a stable transport of the print mediums that have been fed at different speeds over a path between the print unit 20 and the cutter unit 40 (the print unit feeds the print mediums at discretely varying speeds according to the printing speeds and the coating liquid application apparatus provided downstream feeds the print mediums smoothly at a desired constant speed without variations). This feed means receives the print medium 1 printed in the print unit 20 and forwards it to the coating liquid application unit 70. The feed means 50 has plural sets of paired rollers 55A, 55B (in the figure two sets) and a pair of guide plates. The rollers 55A, 55B are rotated by a motor not shown to feed the printed medium 1 in the direction of arrow C.

The coating liquid application unit 70 is basically constructed of the coating liquid application apparatus described with reference to FIG. 1. That is, it includes an application roller 71A, a feed roller 71B, a coating liquid tank 103 storing the coating liquid 100, a drip member 170 for dripping the coating liquid and an application restriction roller 71C that restricts the amount of coating liquid to be applied, with other constitutional components constructed in the similar manner to those of the coating liquid application apparatus.

The print medium 1 introduced into the coating liquid application unit 70 is applied with the coating liquid on its printed surface by the application roller 71A and then carried in the direction of arrow D before being discharged onto a tray 64 where it is stacked on the previously processed print mediums.

The image printing apparatus of this invention, which is constructed as described above, automatically applies the coating liquid to the print medium that has undergone an ink jet printing process, thereby outputting a printed medium with a high weatherability. This image printing apparatus can be realized with a very simple construction in which only the coating liquid application apparatus is installed in a printed medium feed path. This construction reduces the manufacture cost.

In the coating liquid application apparatus described above, however, since the application of the coating liquid to the print medium is done by using only one pair of the application roller and the feed roller, it is difficult to achieve a fast coat application. That is, the coating liquid application apparatus must apply the coating liquid to the print medium 1 at one location only. Hence, when the amount of coating liquid is large and the application operation is performed at high speed, the reception layer of the print medium 1 may not be able to absorb the coating liquid in a short period of time and may become saturated. As a result, a necessary and sufficient amount of coating liquid may not be able to be applied to the print medium.

When it is attempted to increase the amount of coating liquid being applied (i.e., when the amount of coating liquid adhering to the application roller 71A is increased), the coating liquid may temporarily overflow onto the print medium 1 inserted between the pair of rollers 71A, 71B (particularly onto a portion of the print medium immediately downstream of the roller nip portion). In that case, the coating liquid can flow over the print medium and drop into the apparatus, contaminating the interior of the apparatus or adhere to the feed roller causing a slip between the roller and the print medium. Further, during a repair work on a feeding operation failure that occurred during the printing process, the coating liquid that flowed along the print medium may stick to the hands of a worker, hindering the repair work.

Further, in the image printing apparatus described above that automatically applies the coating liquid, because the coating liquid application unit is situated above the print unit 20, the apparatus becomes large and the post processing oil may fall onto the print unit and the feed unit installed in a lower part of the apparatus, contaminating them.

With these taken into consideration and based on the above-described conventional construction, this embodiment of the present invention therefore has the following construction.

(First Embodiment of Coating Liquid Application Apparatus)

Next, a first embodiment of the coating liquid application apparatus according to the present invention will be described.

Figure 4:
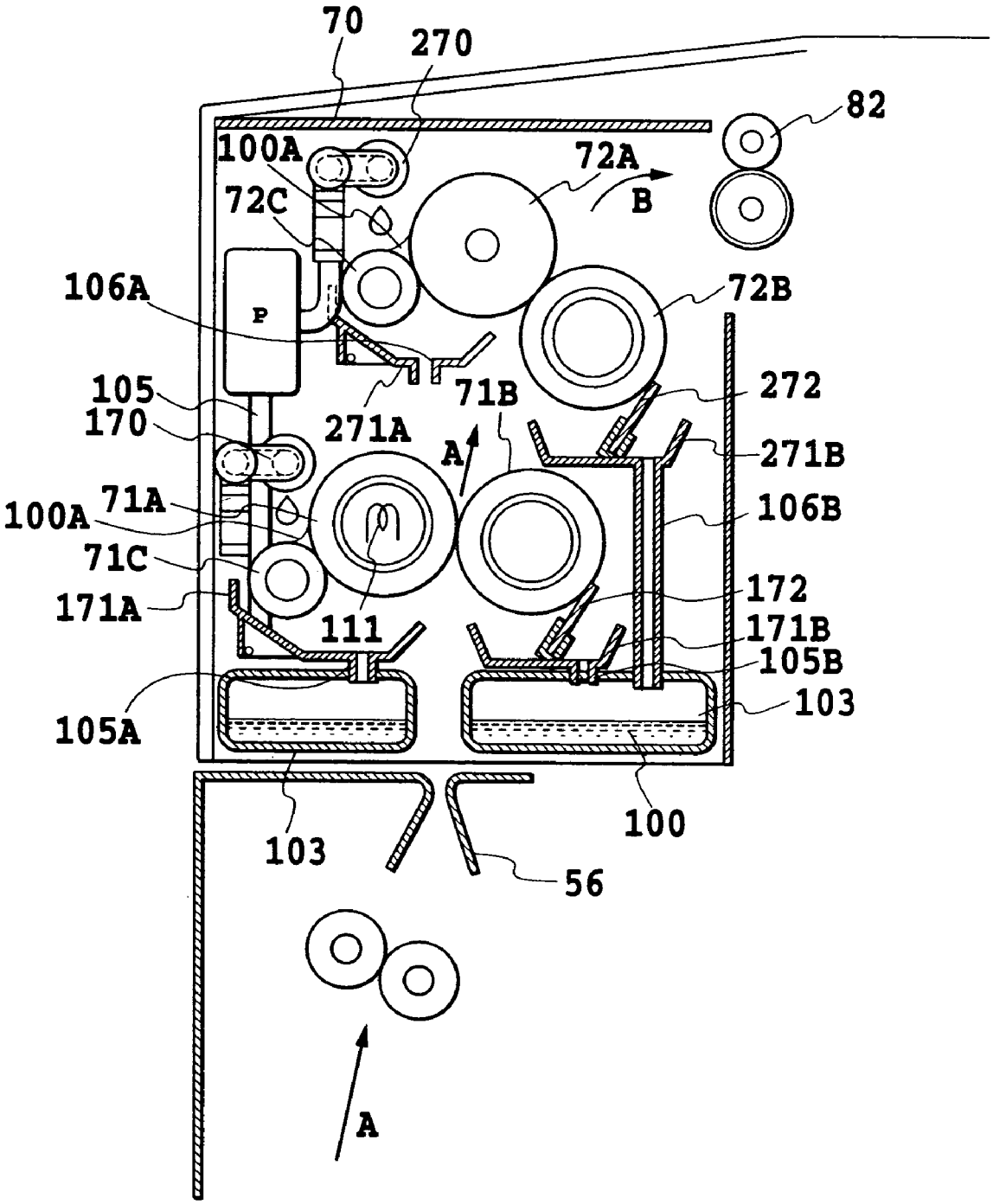
FIG. 4 is a vertical side cross-sectional view showing a first embodiment of the coating liquid application apparatus according to the present invention.

FIG. 4 is an explanatory vertical side cross-sectional view showing a coating liquid application apparatus 70 as the first embodiment which applies the coating liquid to a printed surface of the print medium of the structure described earlier.

In the figure, when the print medium is inserted into an inlet guide 56, with an image-formed surface (a surface formed with the ink reception layer 202) facing up, a medium sensor (not shown) detects the inserted print medium and initiates a sequence of the coat application operation.

The coating liquid 100 is pumped up by a pump P through a pipe 105 to a drip member 170 installed in a top part of the apparatus. The drip member 170 is a pipe extending in a direction perpendicular to a print medium feed direction A (direction perpendicular to the plane of a sheet of the drawing). The pipe forming the drip member 170 has small holes formed in the circumferential surface thereof at almost equal intervals in a longitudinal direction. Thus, the coating liquid 100 pumped up through the pipe 105 drops almost uniformly over the entire length of the drip member 170 through its small holes and is received by an application roller 71A and an application restriction roller 71C, both located below the drip member 170. In the application roller 71A a halogen heater 111 is provided at the rotating center thereof and is kept at a constant temperature by a temperature sensing element such as a thermistor (not shown) and a switching circuit for turning on/off the heater.

The coating liquid 100 thus received by the two rollers 71A and 71C passes through a gap between the rollers 71A and 71C and adheres to a circumferential surface of the application roller 71A, from which it is transferred to a feed roller 71B arranged laterally opposite the application roller 71A. At this time, the application restriction roller 71C is rotating in the same direction as the application roller 71A so that a resistance is imparted to the coating liquid 100 as it passes through the gap between the rollers 71A and 71C. Hence, a puddle 100A of the dripped coating liquid is formed between the rollers 71A and 71C, as shown in FIG. 4. That is, while forming a puddle between the rollers 71A, 71C, the coating liquid is fed out the rollers' gap toward the feed roller 71B side. If there are variations in the coating liquid dripping condition, the puddle 100A can absorb the variations completely, ensuring that an appropriate amount of the coating liquid is almost uniformly applied to the application roller 71A.

The coating liquid 100 used in this embodiment preferably includes dimethyl silicone oils, silicone oils modified by such functional groups as phenyl and alkyl groups, and ester-based oil and varnish. More preferred coating liquids are inert and transparent ones.

That is, the use of an inert coating liquid can minimize problems that would otherwise be caused by various reactions during the handling of the liquid, and the use of a transparent coating liquid can suppress changes in hue of the printed image after being applied with the coating liquid. For automatic application, the coating liquid preferably has, but is not limited to, a low viscosity of about 10–100 centipoise (0.01–0.1 mPa·s). When the viscosity is 10 centipoise (0.01 mPa·s) or lower, the coating liquids often have relatively small molecular weights and are more volatile and evaporable. This makes the coating liquids relatively difficult to handle in the apparatus that is intended for a long period of use. When the viscosity is 100 centipoise (0.1 mPa·s) or higher, the rate at which the coating liquid is absorbed by the ink reception layer is small, so that the print medium after being applied with the coating liquid may become sticky. The problem of the stickiness of the print medium can be solved by suppressing the volatility or slowing down the application speed.

Further, this embodiment uses a liquid of dimethyl silicone oil with a viscosity of 20 centipoise(0.02 mPa·s) to which 5% of ultraviolet absorber is added, and sets the amount of coating liquid to be applied to the print medium at 1.3 g/A4 (i.e., 1.3 g of coating liquid is applied to each A4-size print medium). This was found to be able to provide the coated print medium with a water repellency and to produce an effect of suppressing the ink fading due to radiation of (or exposure to) light such as ultraviolet rays.

Further, in this embodiment a gap of 0.2 mm is formed between the application roller 71A and the application restriction roller 71C. This produced a satisfactory result. It is desired that the gap be optimized according to the amount of coating liquid applied to the print medium (in this embodiment, 1.3 g/A4). For example, when the amount of coating liquid is small, there is no need to provide a gap. Depending on the roller configuration, a certain amount of contact area (nip width) may preferably be provided between the application roller 72A and the application restriction roller 71C. The size of the gap therefore is not limited to a fixed value. Further, although in this embodiment the application restriction member is described to be constructed as a rotatable roller-shaped member, it is not limited to the above construction. For example, the application restriction member may have a shape of a circular cylinder, a semicircular cylinder or a plate, and be fixed and brought into engagement with the application roller 72A. That is, the application restriction member may have any desired construction as long as it can cooperate with the application roller to form the puddle 100A of the coating liquid and still supply a desired amount of coating liquid uniformly onto the application roller.

The print medium inserted from the inlet guide 56 is carried by the paired feed rollers to an engagement portion (hereinafter referred to as a nip portion) between the application roller 71A and the feed roller 71B. After having reached the nip portion between the application roller 71A and the feed roller 71B, the print medium is clamped between the rollers 71A, 71B, that are rotating in the opposite directions at the same speeds, and is fed in the direction A. At this time, the print medium is applied with the coating liquid 100 that was adhering to the application roller 71A. Because the coating liquid uniformly adheres to the application roller 71A, as described earlier, it is uniformly applied to the print medium.

In this process, if the engagement pressure between the application roller 71A and the feed roller 71B is set high enough or the hardness of at least one of the rollers is set low enough (making the nip width large enough) so that the coating liquid can hardly pass through the nip portion, a puddle of the coating liquid can be formed immediately upstream of the nip portion between the application roller 71A and the feed roller 71B (on the inlet side or lower side of the nip portion), too. In that case, the puddle thus formed ensures that a more uniform coat is formed on the print medium.

The coating liquid application apparatus of this embodiment is contemplated to use print mediums that are intended to be printed on only one side (front surface), as shown in FIG. 3, and thus has a construction such that the coating liquid is not applied in large quantity to the back surface of the print medium. That is, a print medium such as shown in FIG. 3 has a resin layer 201*b* on its back that prevents the coating liquid 100 from being absorbed into the back surface. Hence, if the coating liquid is applied to the back surface, it gives an uncomfortable sticky feeling to the user and degrades the writability of the medium, the adhesion with paste and the ease of handling. To deal with this problem, a rubber blade 172 is arranged below the feed roller 71B for cleaning. This cleaning member may be made of a variety of kinds of materials, such as resin and metal and also formed in the shape of brush and roller rather than a platelike blade. Further, an absorbing member such as nonwoven cloth may be brought into engagement with the feed roller 71B. As described above, the cleaning member may have any desired construction as long as it can effectively remove the coating liquid.

Further, this embodiment is so constructed that the coating liquid 100 scraped off by the cleaning member and excess coating liquid supplied to the application roller 71A are recovered to the coating liquid tank 103 through a recovery means.

This recovery means include coating liquid receivers 171A and 171B provided below and out of contact with the rollers 71A, 71C and 71B. When the coating liquid 100 drips excessively onto the rollers 71C, 71A, 71B and excess coating liquid falls from these rollers or when the coating liquid is scrapped off by the cleaning means, the liquid is received by the coating liquid receivers 171A, 171B from which it is immediately recovered to the coating liquid tank 103 through discharge pipes 105A, 105B. With this recovery means, the coating liquid can be circulated in the apparatus at all times, thus preventing a wasteful discarding of the coating liquid 100.

The coating liquid recovered by the recovery means is passed through a filter means (filter 104) to ensure that impurities such as paper dust will not be delivered into the application mechanism. Not only is this filter means used for removing impurities during the coating liquid application operation, it can also be applied to other operations (such as a cleaning mode) in which the coating liquid 100 is circulated through the filter means to remove impurities deposited on the application roller 71A and the feed roller 71B. With this arrangement, since the cleaning means are provided to individual members to remove impurities and deposit them at one location, the impurity removal operation can be performed efficiently.

The application roller 71A used in this embodiment is a rubber roller which has a silicone rubber 1 mm thick wound on the surface of an aluminum core. The feed roller 71B has a foamed sponge arranged on an aluminum core with a PFA tube fitted over the outermost surface thereof. The application restriction roller 71C is constructed of a metal roller of, for example, aluminum.

Hence, because of the silicone rubber the application roller 71A can maintain the wettability of its surface for dimethyl silicone oil as the main component of the coating liquid 100. The feed roller 71B has an enhanced water repellency because of the surface layer of fluoride resin and thus can minimize the amount of coating liquid applied to the back surface of the print medium. And the application restriction roller 71C, because it is made of a metal, can provide an increased precision for a gap. With this embodiment, therefore, not only can an appropriate amount of coating liquid be applied uniformly to the surface of the print medium, but the coating liquid can be prevented from adhering to the back surface of the print medium. As a result, the coating liquid application apparatus of this embodiment can produce an easy-to-handle printed output with an excellent weatherability.

In this first embodiment, there is a second coating liquid application mechanism arranged above the first coating liquid application mechanism including the application roller 71A, the feed roller 71B, the application restriction roller 71C and the drip member 170. That is, the second coating liquid application mechanism has an application roller 72A, a feed roller 72B, a application restriction roller 72C and a drip member 270 connected to the pump P. The print medium that was applied with the coating liquid by the first coating liquid application mechanism is forwarded to the second coating liquid application mechanism where it is further applied with the coating liquid.

The coating liquid application is performed in two stages by the first and second coating liquid application mechanisms, thereby optimizing, and increasing the speed of, the coating liquid application to the print medium.

Since the print medium 1 takes a predetermined time to reach the application roller 72A of the second stage coating liquid application mechanism, the coating liquid applied in the first stage can be absorbed well into the print medium during this forwarding period. After the coating liquid that was applied in the first stage has been absorbed well, an additional amount of coating liquid is further applied over the previous coat in the second stage. This increases the penetration performance of the coating liquid. Therefore, the two-stage application can coat the print medium with more than two times the amount of coating liquid that can be applied in a single stage.

In this embodiment the halogen heater 111 is provided in the application roller 71A of the first stage. Even when the ink ejected onto the print medium during the image forming process is not well dried, this halogen heater 111 can quicken the drying of the ink and keep the viscosity of the coating liquid low, thus significantly increasing the amount of coating liquid that the ink reception layer can absorb. Further, because the residual heat of the print medium that was heated at the first stage can be used for the second stage coating liquid application, the absorption of the coating liquid can also be improved substantially.

In the first embodiment these effects were obtained by setting the temperature of the halogen heater 111 at 80°. This temperature should be adjusted according to conditions, such as the coating liquid and print medium used, heat resistances of various rollers, power consumption, standby time and speed.

Further, in this embodiment, the amount of coating liquid applied in the first stage application mechanism was set at 0.8 g/A4 and that of the second stage application mechanism was set at 0.5 g/A4. Since a sufficient time to absorb the coating liquid can be provided while the print medium moves from the first to the second stage, the volume of coating liquid to be applied at the first stage is set larger than that of the second stage. The amount by which the first stage application volume falls short of the total required application volume is provided by the second stage application mechanism. This method prevents the coating liquid from overflowing from between the application roller and the feed roller and can reliably apply an appropriate amount of coating liquid. Moreover, since the coating liquid application is performed at two locations, the first and second stages, the required amount of the coating liquid can be applied in a reduced length of time.

Further, in this embodiment, the direction in which the print medium is transported is set nearly vertical, as shown in the figure, and the nip portion between the application roller and the feed roller is directed relatively vertical. This arrangement can minimize the coating liquid from staying in an excessive amount on the downstream side of the nip portion (on the outlet side or upper side of the nip portion) with respect to the print medium feeding direction. This also effectively serves to prevent the coating liquid from overflowing into the interior of the apparatus. The print medium that was applied with the coating liquid by the second stage application mechanism is discharged outside of the apparatus by a pair of discharge rollers 82.

Further, to simplify the construction and reduce the cost, a single pump P is commonly used for pumping the coating liquid up to the drip member 170 and the drip member 270. However, a pump may be provided individually for each drip member. The only requirement is that each pump must be able to deliver as much of the coating liquid as or slightly more than is required to be dripped from the respective drip members. In the second application mechanism too, the excess coating liquid can be recovered to the coating liquid tank 103 through a recovery means similar to that used in the first stage application mechanism. That is, the recovery means for the second stage application mechanism comprises coating liquid receivers 271A, 271B and discharge pipes 106A, 106B. The feed roller 72B in the second stage application mechanism is also provided with a blade (cleaning means) 272 similar to the blade 172 for the feed roller 71B in the first stage application mechanism.

(First Embodiment of Image Printing Apparatus according to this Invention)

Next, a first embodiment of the image printing apparatus according to the present invention will be described.

The image printing apparatus of this embodiment incorporates the coating liquid application apparatus explained with reference to FIG. 4 and has a construction shown in FIG. 5.

Figure 5:
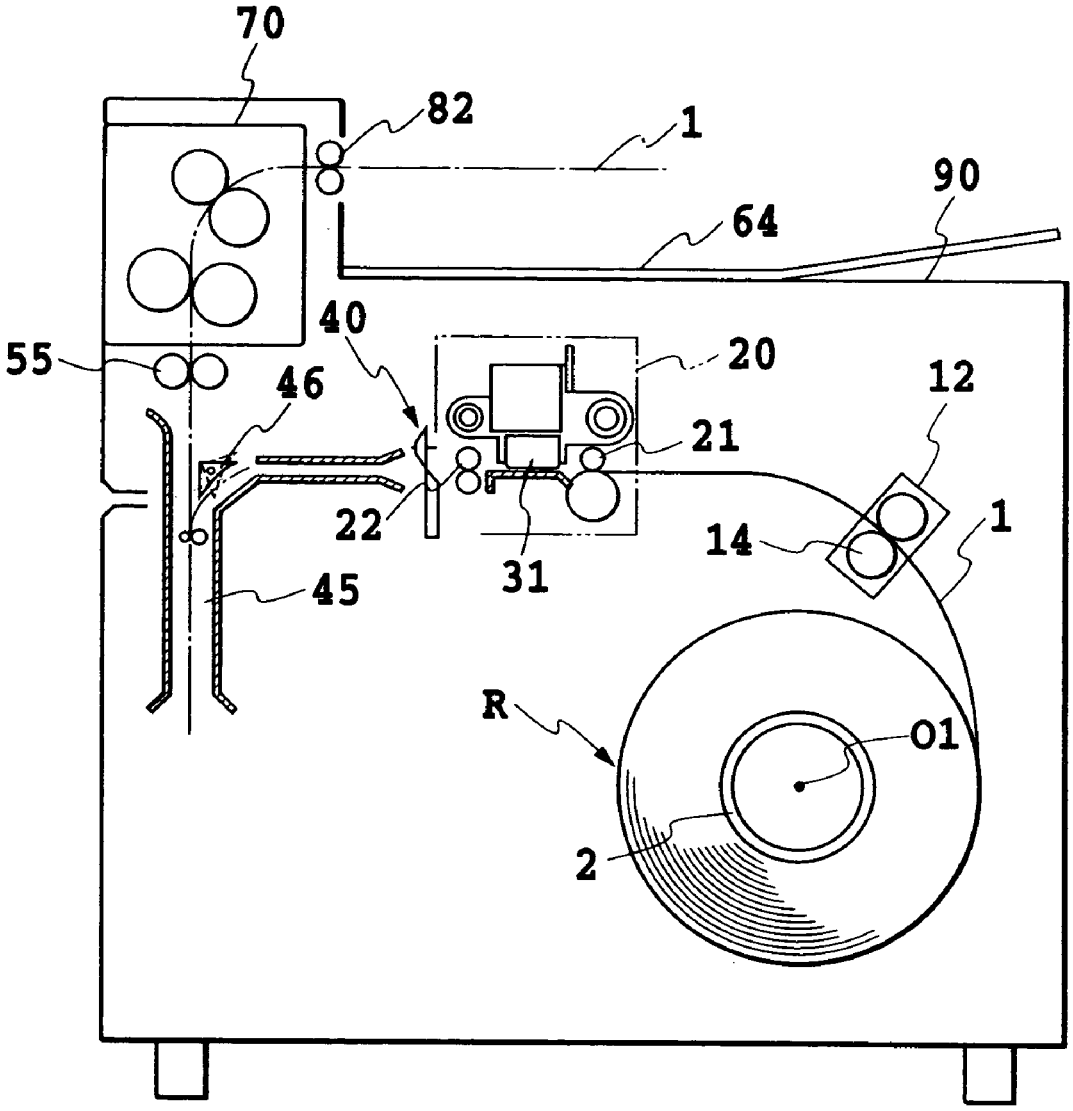
FIG. 5 is a vertical side cross-sectional view showing a first embodiment of the image printing apparatus according to the present invention.

In an image printing apparatus of FIG. 5, a roll of print medium wound on a paper core 2 is accommodated in a cartridge (not shown). The paper core 2 is supported rotatably about an axis O1. The print medium 1 payed out from the roll R is passed between a pair of rollers 12, 14 and fed to a print unit 20 which has an ink jet print head 31.

Then, between a pair of feed rollers 21 and a pair of feed auxiliary rollers 22 the print medium is printed with an image by ink droplets ejected from ink ejection nozzles of the ink jet print head 31.

The ink jet print head 31 is constructed to use, for example, thermal energy to expel ink droplets from the ink ejection nozzles. The print head 31 is provided with electrothermal transducers, one for each nozzle. Each electrothermal transducer is applied with a drive pulse according to print data to generate heat, which causes film boiling in the ink whereby a growth of a bubble expels an ink droplet from the associated ink ejection nozzle. Another example of the widely used ink jet print head 31 uses electromechanical transducers, such as piezoelectric elements, that change their volume upon application of electric energy and expel ink droplets from the ink ejection nozzles by their volume change.

Designated 40 is a cutter unit as a cutting means provided downstream of the print unit 20. The cutter unit 40 cuts to a desired length the print medium 1 that was fed from the roll and printed with an image by the print unit 20.

In the print unit 20, as the print head 31 performs serial scans, the print medium 1 is fed at a predetermined pitch. After having been printed and passed through the cutter unit 40, the print medium 1 is fed at a predetermined speed. At this time, if the print medium is long compared with the length of a path leading up to a location where it is desired that the print medium be moved at a constant speed, such as the coating liquid application unit 70, then the print medium 1 is temporarily carried to a buffer portion 45 before being transported to the coating liquid application unit 70. With this arrangement, there are no restrictions on the positions of the rollers and application unit, assuring that a long print medium can be properly printed and applied with a coating liquid.

After the print medium 1 is printed by the print unit 20 and cut by the cutter unit 40, a flapper 46 pivots to a position indicated by a dashed line in the figure, switching the direction of transport of the print medium. As a result, the print medium is carried to buffer portion 45, from which it is further transported through feed rollers 55 to the coating liquid application unit (coating liquid application apparatus) 70.

The coating liquid application unit 70 shown here has the same construction as the coating liquid application apparatus shown in FIG. 4, and applies a coating liquid to the ink reception layer of the print medium fed by the feed rollers 55 before discharging the print medium onto the tray 64 where it is stacked on the previously processed printed mediums.

The image printing apparatus of this embodiment with the above construction automatically applies a coating liquid to a print medium after inkjet-printing the print medium, thereby outputting a printed medium with a high weatherability. This image printing apparatus can be realized with a very simple construction in which only the coating liquid application apparatus is installed in a printed medium feed path. This construction reduces the manufacture cost.

(Second Embodiment of Image Printing Apparatus according to this Invention)

In the first embodiment of the image printing apparatus of this invention, the direction of transport of the print medium during the coating liquid application is set vertical, as described above, to avoid the coating liquid dripping from the rollers. The direction of transport of the print medium is not limited to this example and may be set in other directions, as in the image printing apparatus of the second embodiment shown in FIG. 6.

Figure 6:
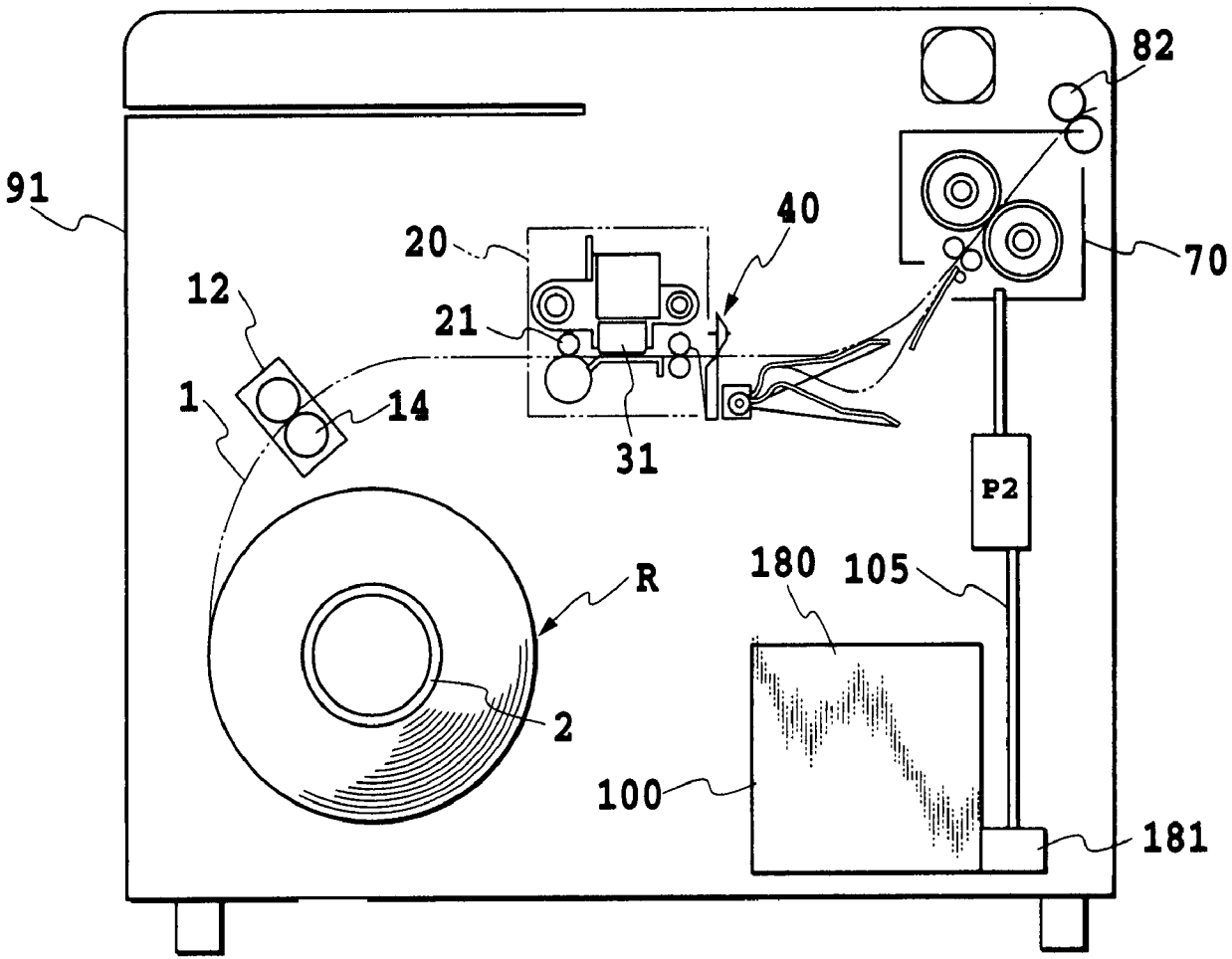
FIG. 6 is a vertical side cross-sectional view showing a second embodiment of the image printing apparatus according to the present invention.

The second embodiment will be explained by referring to FIG. 6. Parts identical with or corresponding to those of the first embodiment are given like reference numbers and their explanations are omitted.

In an image printing apparatus 91 as the second embodiment, a print medium payed out from the roll R is fed by a pair of rollers 12, 14, printed by a print unit 20, and cut to a predetermined length by a cutter unit 40. The construction described so far is similar to that of the first embodiment. What differs from the first embodiment is that this second embodiment does not use the buffer unit such as shown in FIG. 5 in feeding the print medium but directly forwards it from the print unit 20 to the coating liquid application unit 70. It should also be noted that the path following the cutter unit 40 is inclined upward.

This embodiment has a replacement tank 180 filled with a coating liquid 100, a reservoir tank 181 that continuously extracts an appropriate amount of coating liquid from the replacement tank 180 and manages the liquid level by a sensor (not shown), and a pump P2 and a pipe 105 that supply the coating liquid from the reservoir tank 181 to the coating liquid tank 103 in the coating liquid application apparatus 70. This arrangement differs from the first embodiment.

In the second embodiment of the above construction, when the replacement tank 180 runs out of the coating liquid, the entire replacement tank need only be replaced to continue the coating liquid application operation. This arrangement can be expected to reduce required space (installation area) and improve recovery and refilling performances.

To describe in more detail, in the coating liquid application apparatus 70, it is assumed that the total volume of coating liquid to be applied to the print medium is 1.3 g/A4, as in the first embodiment, of which 0.3 g/A4 is applied in the first stage and the remaining 1.0 g/A4 is applied in the second stage. The amount applied at the first stage is considerably small and this level of coating liquid application will not result in an excess coating liquid dripping during the application operation. Nor will the coating liquid flow down the print medium and drop onto the inlet guide 56 even when the print medium stops moving due to some feeding trouble during the coating liquid application operation. However, when the similar trouble occurs at the second stage, the oily coating liquid 100 may flow down the halted print medium 1 and drip. At this time, if the rollers 71A and 71B are made to clamp the print medium firmly, the coating liquid can be kept remaining near the nip portion on the upper side of the roller pair.

Here, pulling the print medium downward can squeeze the coating liquid out of the print medium by the nip portion. The print medium is then taken out from under the nip portion and the squeezed coating liquid can be recovered for reuse by rotating the rollers in the forward direction (the same direction of rotation as during the application operation).

By slightly inclining upward the print medium transport path in the application operation as in this embodiment, it is possible to reduce the installation area and allow the coating liquid replacement tank to be installed below.

(Second Embodiment of Coating Liquid Application Apparatus according to this Invention)

Next, a second embodiment of the coating liquid application apparatus according to the present invention will be described by referring to FIG. 7. The coating liquid application apparatus of this embodiment is not intended to be installed in the image printing apparatus but used as a standalone coating liquid application apparatus.

In this embodiment, n or more ($n \geqq 3$) of the coating liquid application means each comprising an application roller and an application restriction roller are provided.

Figure 7:
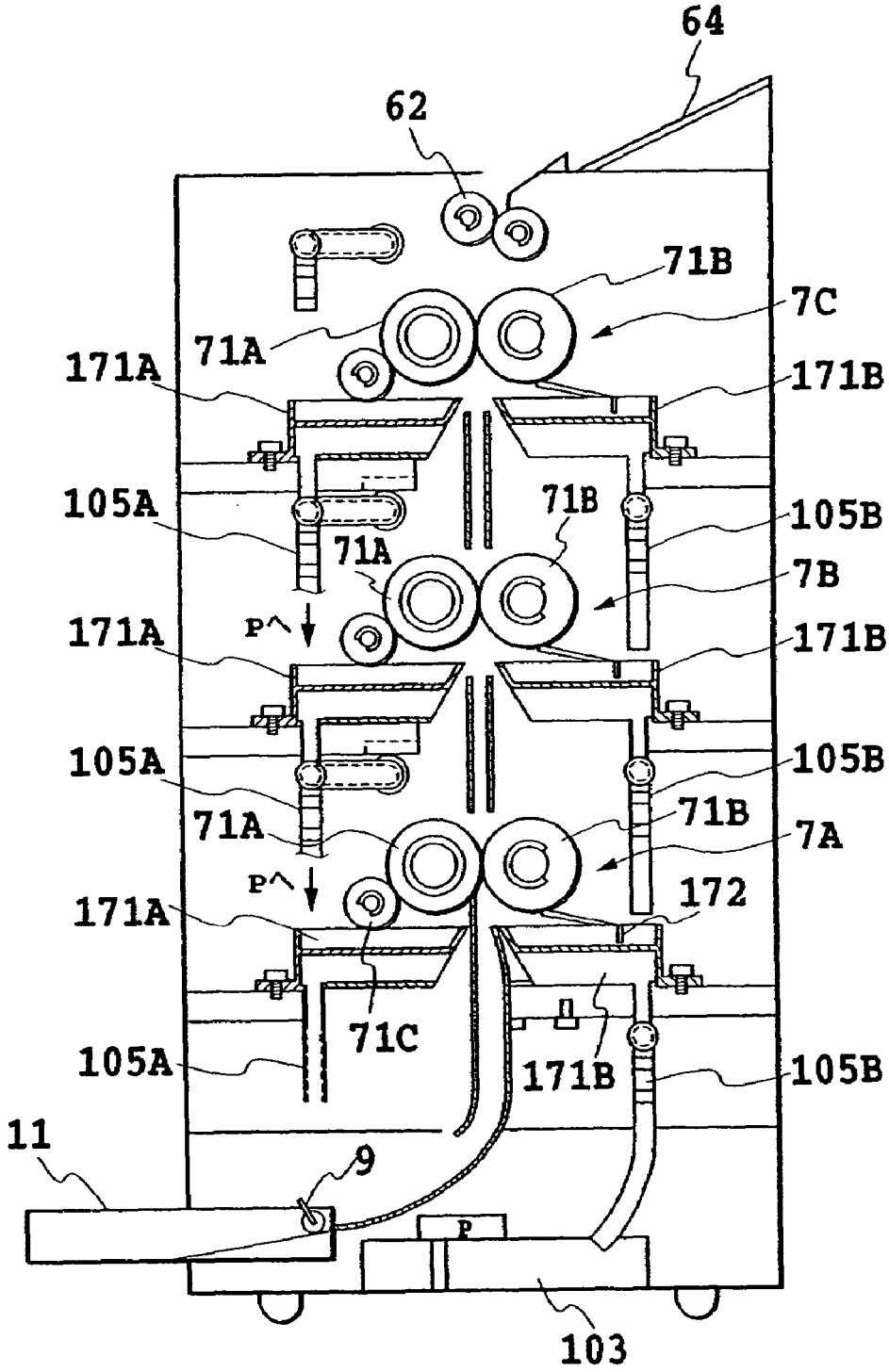
FIG. 7 is a vertical side cross-sectional view showing a second embodiment of the coating liquid application apparatus according to the present invention.

As shown in FIG. 7, this embodiment has first to third stage application mechanisms 7A, 7B, 7C arranged in a vertical direction and thus a path connecting these application mechanisms runs almost vertically. Each of these application mechanisms is of almost the same construction and has an application roller 71A, a feed roller 71B and an application restriction roller 71C. A coating liquid tank 103 is provided at the bottom of this apparatus. For each application mechanism there is provided a recovery means which comprises coating liquid receivers 171A, 171B and discharge pipes 105A, 105B. Therefore, the application mechanisms in this embodiment basically have almost the same construction as that of the application mechanism in each stage shown in FIG. 4. The two discharge pipes 105A, 105B provided in the second and third stage application mechanisms are arranged above the corresponding coating liquid receivers provided in the next stages downs, respectively. The coating liquid collected in the coating liquid receivers 171A, 171B in the third stage flows down the discharge pipes 105A, 105B onto the second stage receivers 171A, 171B, from which it further flows down onto the first stage receivers 171A, 171B. This arrangement can simplify the piping design, installation and operation. The discharge pipes may also be communicated directly to the coating liquid tank 103.

When a coating liquid is to be applied to the ink reception layers of the print mediums by using the coating liquid application apparatus of the above construction, the user puts the printed mediums on a cassette 11 and presses a start button. Then, a pickup roller 9 picks up the print mediums one at a time and sends them to the first stage application mechanism. After this, the print mediums are successively forwarded from the first stage application mechanism 7A to the second stage application mechanism 7B to the third stage application mechanism 7C, from which the processed print mediums are discharged by a pair of discharge rollers 82 onto the tray 64 where they are stacked.

In the first stage application mechanism 7A a halogen heater 111 is provided inside the application roller 71A to heat and dry the print medium for the coating liquid to be easily absorbed. A small amount of coating liquid is applied to the application roller 71A to maintain a releasability of the print medium.

Next, in the second stage application mechanism 7B, since the print medium is already in a state that can easily absorb the coating liquid, as much coating liquid 100 as possible is applied. In the final third stage application mechanism 7C, a small amount of coating liquid is applied so that it does not overflow from the ink reception layer. This arrangement can assign the three application mechanisms with slightly different functions and realize a stable coating liquid application apparatus.

Although in this embodiment each of the first to third stage application mechanisms is constructed in almost the same manner as the application mechanism of each stage shown in FIG. 4, these application mechanisms are not limited to this construction. Any other construction may be adopted as long as the print medium is passed between a pair of opposing rollers to be applied with the coating liquid.

In the above embodiments, a coating liquid such as post processing liquid has been described to be applied to the ink reception surface of the print medium that was printed with ink. The present invention is also applicable to the application of preprocessing liquid to the print mediums.

As described above, in this invention a plurality of stages of application mechanisms are provided each of which has a pair of rollers supplied with a liquid coating agent for improving a weatherability of a print medium, and the print medium is passed through each application mechanism to apply the coating liquid to the print medium in a plurality of stages. With this arrangement, not only can the coating liquid be automatically applied to the print medium without requiring the user to perform any troublesome work, it can also be applied in a necessary and sufficient amount at high speed and in a proper manner. Further, the coating liquid can be prevented from dripping onto undesired locations in the apparatus, thus improving a maintainability.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A coating liquid application apparatus for applying a coating liquid to a print medium that was printed with an ink image, comprising:

an application roller for applying the coating liquid to the print medium;

a feed roller arranged opposite said application roller for conveying the print medium;

supply means for supplying the coating liquid from a tank to said application roller;

a blade for scraping the coating liquid off said feed roller; and recovery means for recovering the coating liquid scraped off by said blade and returning the recovered coating liquid to the tank, wherein said blade scrapes the coating liquid off said feed roller at a position at a level lower than a position where the coating liquid is applied by said application roller.

2. A coating liquid application apparatus according to claim 1, wherein said recovery means recovers excessive coating liquid supplied to said application roller and returns the excessive coating liquid to the tank.

3. A coating liquid application apparatus according to claim 1, further comprising a pump for pumping the coating liquid up from the tank to said application roller.

4. A coating liquid application apparatus according to claim 1, wherein said recovery means recovers excessive coating liquid supplied to said application roller and returns the excessive coating liquid to the tank through a pipe.

5. A coating liquid application apparatus according to claim 1, further comprising a filter through which the coating liquid recovered by said recovery means passes.

6. An image forming apparatus comprising:

printing means for performing ink jet printing on a print medium;

an application roller for applying coating liquid to the print medium;

a feed roller arranged opposite said application roller for conveying the print medium;

supply means for supplying the coating liquid from a tank to said application roller;

a blade for scraping the coating liquid off said feed roller; and recovery means for recovering the coating liquid scraped off by said blade and returning the recovered coating liquid to the tanks, wherein said blade scrapes the coating liquid off said feed roller at a position at a level lower than a position where the coating liquid is applied by said application roller.

7. An image forming apparatus according to claim 6, wherein said recovery means recovers excessive coating liquid supplied to said application roller and returns the excessive coating liquid to the tank.

8. An image forming apparatus according to claim 6, further comprising a pump for pumping the coating liquid up from the tank to said application roller.

9. An image forming apparatus according to claim 6, wherein said recovery means recovers excessive coating liquid supplied to said application roller and returns the excessive coating liquid to the tank through a pipe.

10. An image forming apparatus according to claim 6, further comprising a filter through which the coating liquid recovered by said recovery means passes.

11. An image forming apparatus according to claim 6, wherein said feed roller contacts a lower surface of the print medium.

* * * * *

UNITED STATES PATENT AND TRADEMARK OFFICE

CERTIFICATE OF CORRECTION

PATENT NO. : 7,211,151 B2
APPLICATION NO. : 11/128213
DATED : May 1, 2007
INVENTOR(S) : Takekoshi et al.

It is certified that error appears in the above-identified patent and that said Letters Patent is hereby corrected as shown below:

COLUMN 7:
Line 20, “not shown” should read --(not shown)--.

COLUMN 9:
Line 26, “centipoise(0.02” should read --centipoise (0.02--.
Line 43, “roller 72A” should read --roller 71A--.
Line 51, “roller 72A.” should read --roller 71A.--.
Line 63, “the” (second occurrence) should be deleted.
Line 64, “speeds,” should read --speed,--.

COLUMN 10:
Line 40, “include” should read --includes--.
Line 45, “scrapped” should read --scraped--.

COLUMN 15:
Line 14, “downs,” should read --down,--.

COLUMN 16:
Line 62, “tanks,” should read --tank,--.

Signed and Sealed this

Third Day of March, 2009

JOHN DOLL
*Acting Director of the United States Patent and Trademark Office*